US011111462B2

(12) United States Patent
Astolfi et al.

(10) Patent No.: US 11,111,462 B2
(45) **Date of Patent: *Sep. 7, 2021**

(54) SOAP BAR HAVING SEPARATE CONCENTRATED REGIONS OF SPECIFICALLY SELECTED COMPONENTS

(71) Applicant: Conopco, Inc., Englewood Cliffs, NJ (US)

(72) Inventors: Rafael Astolfi, São Paulo (BR); Jorge Luiz Basso, Valinhos (BR); Sergio Roberto Leopoldino, São Paulo (BR); Luiz Felipe Costa Vidigal, Belo Horizonte (BR); Venugopal Vijayakrishnan, Mumbai (IN); Yuriy Konstantinovich Yarovoy, Monroe, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 240 days.

This patent is subject to a terminal disclaimer.

(21) Appl. No.: 15/767,748

(22) PCT Filed: Oct. 12, 2016

(86) PCT No.: PCT/EP2016/074503
§ 371 (c)(1),
(2) Date: Apr. 12, 2018

(87) PCT Pub. No.: WO2017/064137
PCT Pub. Date: Apr. 20, 2017

(65) Prior Publication Data

US 2018/0305642 A1 Oct. 25, 2018

(30) Foreign Application Priority Data

Oct. 16, 2015 (EP) ..... 15190278

(51) Int. Cl.
*C11D 9/00* (2006.01)
*C11D 13/18* (2006.01)

(52) U.S. Cl.
CPC ..... *C11D 9/007* (2013.01); *C11D 13/18* (2013.01)

(58) Field of Classification Search
CPC ..... C11D 9/007
See application file for complete search history.

(56) References Cited

U.S. PATENT DOCUMENTS 5,540,852 A * 7/1996 Kefauver ..... A61K 8/361 510/152
5,656,579 A * 8/1997 Chambers ..... C11D 17/006 510/152

(Continued)

FOREIGN PATENT DOCUMENTS

EP 3362546 4/2019

OTHER PUBLICATIONS

Search Report and Written Opinion in EP15190278, dated Apr. 29, 2016.

(Continued)

*Primary Examiner* — Necholus Ogden, Jr.
(74) *Attorney, Agent, or Firm* — Edward A. Squillante, Jr.

(57) ABSTRACT

The present invention relates to bars comprising soap bar matrix comprising predominantly long chain length soap and regions or domains interspersed within the matrix comprising predominantly shorter chain soaps. The novel bars of the invention are sufficiently hard to survive large scale manufacturing while simultaneously delivering benefits of significant foam value enhancement, for example, due to delivery of short-chain soaps from concentrated regions. Surprisingly, even when soaps in concentrated (Continued)

regions comprise small percentage of overall soap oils or fats used, they form observable kappa phase pattern.

13 Claims, 4 Drawing Sheets

(56) References Cited

U.S. PATENT DOCUMENTS

| | | | | |
|---|---|---|---|---|
| 5,750,481 | A | 5/1998 | Del Vecchio et al. | |
| 6,730,642 | B1 | 5/2004 | Aronson et al. | |
| 2009/0025602 | A1 | 1/2009 | Kwan et al. | |
| 2011/0039745 | A1 | 2/2011 | Hermanson et al. | |
| 2011/0039746 | A1* | 2/2011 | Hermanson ..... | C11D 13/02 510/159 |
| 2013/0281343 | A1* | 10/2013 | Astolfi ..... | A61Q 19/10 510/153 |

OTHER PUBLICATIONS

Search Report and Written Opinion in PCTEP2016074503, dated Dec. 16, 2016.
Search Report and Written Opinion in PCTEP2016074510, dated Dec. 16, 2016.

* cited by examiner

SOAP BAR HAVING SEPARATE CONCENTRATED REGIONS OF SPECIFICALLY SELECTED COMPONENTS

FIELD OF THE INVENTION

The invention relates to predominantly fatty acid soap bar compositions. It relates to bar compositions having regions (which can be defined, for example, by a kappa phase pattern), for example, of predominantly shorter chain soaps (separately prepared and added), and which regions comprise typically about 3 to 25% (of total bar volume) of the final bar composition. The predominant bar matrix (comprising typically about 75% to 97% of final bar volume) contains primarily higher chain length soaps, which are the typical bricks and mortar of soap bar compositions. By providing bars where predominantly short chain soap regions are interspersed within a predominantly long chain soap bar matrix, applicants provide bars which can be extruded well (defined by acceptable hardness values), yet deliver benefits provided by the shorter chain soaps (e.g., enhanced foaming) which would be lost or minimized if the blend of soaps had been prepared in a single step saponification process. Further, because benefits are delivered from concentrated area, the same benefit can be achieved using much lower levels, for example, of short chain soap overall.

BACKGROUND OF THE INVENTION

Soap bars for cleansing are typically prepared by saponifying (neutralizing) triglyceride/fatty acids. In this saponification process, various fats (e.g., tallow, palms and coconut oil blends) are saponified in the presence of alkali (typically NaOH) to yield alkaline salts of fatty acids (derived from the fatty acid chains forming the glyceride) and glycerol. Glycerol is then typically extracted with brine to yield dilute fatty acid soap solution containing soap and aqueous phase (e.g., 70% soap and 30% aqueous phase). The soap solution is then typically dried (e.g. to about 15% water) and the remaining mass is typically mixed, milled, plodded, cut and stamped into bars. Alternatively, the soap solution can be cast into moulds, blisters, etc.

The chain length of fatty acid soaps found in the final bar varies depending on the starting fat or oil feedstock (for purposes of this specification, "oil" and "fat" are used interchangeably, except where context demands otherwise). Longer chain fatty acid soaps (e.g., $C_{16}$ palmitic or $C_{18}$ stearic) are typically obtained from tallow and palm oils, and shorter chain soaps (e.g., $C_{12}$ lauric) may typically be obtained from, for example, coconut oil or palm kernel oil. The fatty acid soaps produced may also be saturated or unsaturated (e.g., oleic acid).

Typically, longer molecular weight fatty acid soaps (e.g., $C_{14}$ to $C_{22}$ soaps) are insoluble and do not readily generate foam, despite the fact that they can help making the foam generated by other soluble soaps creamier and more stable. Conversely shorter molecular weight soaps (e.g., $C_8$ to $C_{12}$) and oleic acid chain length soaps lather quickly. However, the longer chain soaps (typically saturated, although they may also contain some level of unsaturated such as oleic) are desirable in that they help maintain the structure of the bar and do not dissolve as readily. Unsaturated soaps (e.g., oleic) are soluble and contribute to a denser, creamier foam, like the longer chained soaps.

Since, as noted, all the fats are added, saponified and dried at the beginning of the process, saponification of both long and short chain length materials occurs together and the final soaps are distributed homogeneously throughout the final bar product after finishing. No concentrated regions of specific chain length soaps are made when varying chain length soaps are saponified together.

Typically, skin benefit agents, which will form part of the final bar, may be added together with the fats during saponification or during drying stages (where temperatures are very high, for example, above 100° C.). However when these ingredients are added in specific product variants, they are normally added during mixing (at lower temperatures) to avoid complexity in the factories. The benefit agents are normally liquids, pastes or soft particle and can adequately be added at this later stage. Addition of benefit agents (e.g., silicones; humectants such as glycerol or sorbitol; emollients, such as isopropyl palmitate) during saponification/drying ensures they are thoroughly and homogeneously mixed. This is true even for benefit agents which have relatively high melting points (e.g., greater than 50° C., typically greater than 60° C.). Such benefit agents can readily mix at temperatures typically used for saponification (90 to 120° C.), and heat and efficient mixing ensure full homogenization and homogeneous incorporation of benefit agent throughout the final soap matrix.

As noted, some benefit agents (which we refer to as "finishing adjuvant materials") can be and are typically added after saponification and drying, and just before soap noodles (e.g., soap noodles comprising benefit agents which are added at the saponification stage) are mixed, milled, plodded, etc. Typically, this second type of benefit agent are those that improve the aesthetic quality of the bar, especially the visual, tactile and olfactory properties, either directly (perfume) or indirectly (preservatives).

Examples of adjuvants (both "non-finishing" materials which may be added at saponification, or "finishing" materials which may be added after saponification and at the mixing stage) include but are not limited to perfumes; opacifying agents such as fatty alcohols, ethoxylated fatty acids, solid esters, and $TiO_2$; dyes and pigments; pearlizing agent such as $TiO_2$ coated micas and other interference pigments; plate like mirror particles such as organic glitters; sensates such as menthol and ginger; preservatives such as dimethyloldimethylhydantoin (Glydant XL 1000), parabens, sorbic acid and the like; antioxidants such as, for example, butylated hydroxytoluene (BHT); chelating agents such as salts of ethylene diamine tetra acetic acid (EDTA) and trisodium etridronate; emulsion stabilizers; auxiliary thickeners; buffering agents; and mixtures thereof.

Adjuvants are typically added at a level of between about 0.1% to about 3%, preferably between 0.1% and 0.5% and most preferably between about 0.2 to about 0.4% based on the total weight of the bar composition. As noted above, different adjuvants may be added at or after saponification.

As indicated, many adjuvant materials/benefit agents have relatively low melting points (lower than 50° C.). By contrast, soaps produced during the saponification process (typically made with $C_{16}$ $Na^+$/$C_{18}$ $Na^+$/$C_{18}$:1 $Na^+$) typically have melting points above 100° C. Thus, these materials will not melt during the post-saponification finishing stages when finishing adjuvants are typically added.

Unexpectedly, applicants have now found that if, rather than saponifying all fat materials (comprising mixture of all chain lengths) in a one-step process, fats in which 75% or greater of the chain lengths available for saponification and/or neutralization are $C_{14}$ or greater are saponified separately (in a different stream) from fats in which 75% or greater of the chain lengths available for saponification and/or neutralization are $C_{12}$ or less, tremendous benefits are achieved.

Specifically, one stream will produce soaps in which 75% by wt. or more of the soap molecules produced are $C_{14}$ or greater, and one will produce soaps in which 75% or more by wt. of the soap molecules produced are $C_{12}$ or less. Because the soaps are made at a different stage in the process, the two types of soap may be combined and mixed later at much lower temperatures. As a result, the soap blends are not homogenized and instead form concentrated regions or domains (the term "regions" and "domains" are used interchangeably) of predominantly short chain soaps interspersed in a matrix of predominantly long chain soaps and which regions are better able to deliver foam. Although mixing time can certainly be longer, mixing time is typically 1 to 15 minutes, preferably 2 to 10 minutes. The different saponification streams also permit different counterions to be used in each saponification stream reaction, if needed.

Further, benefit agents with typically lower melting points than those used in the "main stream" previously noted (typically "finishing" adjuvants), and which normally would be homogenized and dispersed throughout the final bar during a typical one-step saponification process, can be added when the two soaps (formed in separate saponification steps) are later combined and mixed at the lower temperature. Since these finishing adjuvants are added at a lower temperature part of the process when the two soaps are combined, they will tend to stay in the non-homogenized regions defined by the lower-chain soaps formed with which they will be interacting. Because the lower chain soaps are concentrated in separate regions, they generate much better foam (quantity and quality) upon bar use. Further, because the lower chain soaps solubilize more quickly on rinse, the benefit agents which are entrapped in the region also can be more readily delivered.

Although benefit agents can be added during saponification or post saponification (at lower temperatures) of either stream, the step at which the soaps are combined (at much lower temperatures) allows incorporation of low melting point benefit agents into the regions which will form when the soaps are combined and bars are formed. However, selection of benefit agents with specific melting points can still be important. If the melting point of the agents is too low, when the two soaps are mixed, the benefit agents may homogenize even at the relatively low mixing step temperature, and the agents may not stay in the regions for delivery (e.g., they may migrate and interact with main bar matrix); if the melting point is too high, they may stay in the regions, but they may also remain gritty and not provide performance benefits. In general it is preferred that lower melting point benefit agent be added to the saponification stream where short chain soaps are being made, but after the saponification (when temperature is lower) and before the streams are mixed; or that they be added when both soaps are combined.

Typically, we have found that, when benefit agents are added at a temperature of about 30 to 50° C., preferably 25 to 45° C., more preferably 38 to 42° C., the benefit agent (whether added post saponification and during formation of short chain soap; or after the two streams are mixed) tend to remain with the soap forming the concentrated regions and to also provide desired performance benefits (e.g., they are not too gritty).

The performance of low-chain soap regions can be further enhanced by the ability to select counterions used for saponification. Further, different performance benefits may be achieved in theory by separate addition (at lower temperature stages) of solid, separately made, non-soap detergents.

U.S. Pat. No. 6,730,642 to Aronson et al. disclose extruded multiphase bars in which there is a separately prepared discontinuous phase which is harder than a continuous phase. However, there is no difference disclosed in the composition of the chain lengths of both phases and no disclosure or suggestion that there be a second saponification using predominantly shorter chain fats and done at a different stage than the first saponification. There is no disclosure of mixing the two streams at a defined lower temperature range. Further, the separate phases are mixed for aesthetic purposes only. There is certainly no recognition that lather or other benefits can be delivered when concentrated regions of predominantly low chain-length soaps are formed.

No reference of which applicants are aware disclose soap bars having a main bar matrix comprising predominantly long chain soap and separate regions or domains comprising predominantly low chain length soap. No reference discloses a process for making such bars, or the benefits resulting from such bar. Further, no reference discloses the selection of benefit agents (preferably added during formation of low chain soaps, and/or in a separate stream at the times the low chain soaps and high chain soap are combined and mixed) having defined melting point ranges (e.g., 30° to 50° C.) such that, as indicated, when the benefit agents are mixed at the lower mixing temperature, they will remain with soaps forming the concentrated domains, yet remain sufficiently non-gritty as to provide benefits.

The present invention is directed to compositions having concentrated regions as defined above and an accompanying case is directed to the process of the invention.

BRIEF DESCRIPTION OF THE INVENTION

The present invention is directed to a soap bar composition which comprises a main region of predominantly long chain soaps, forming a majority matrix (about 75-97% of total bar volume), in which smaller, concentrated regions or domains are found; and concentrated regions of predominantly short chain soaps found throughout the bar, wherein said bar comprises:

1) a bar matrix (about 75 to 97% total bar volume) wherein 75% or greater, preferably 80% or greater, more preferably 82% or greater, more preferably 85% by wt. or greater of the soap molecules formed during saponification (based on starting fats selected such that 75% or greater of chain lengths available for saponification are $C_{14}$ or greater) have a chain length of $C_{14}$ or greater (preferably $C_{14}$ to $C_{24}$, more preferably $C_{16}$ to $C_{18}$ and $C_{18:1}$); the soap formed preferably comprises 50 to 85% by wt. of the bar matrix and (as a result of selection of fats and separate stream saponification) 75% by wt. or greater of the soap in the final matrix has chain length of $C_{14}$ or greater (15% to 50% by wt. of matrix is made up of other materials defined below); and
2) regions or domains of concentrated soap (comprising about 3 to 25% of total bar volume) dispersed throughout the majority soap matrix prepared from fats wherein 75% or greater, preferably 80% or greater, more preferably 82% or greater, even more preferably 85% by wt. or greater of the soap molecules formed during saponification (based on starting fats selected such that 75% or greater of chain lengths available for saponification or neutralization are $C_{12}$ or less) have a chain length of $C_{12}$ and below, preferably $C_8$ to $C_{12}$; the soap formed comprises 50-85% of the concentrated bar regions (15% to 50% by wt. made of other materials) and 75% by wt. or greater of the soap in the final region (as a result of selection of fats and separate stream saponification) has chain length of $C_{12}$ or less.

The long chain soaps which will form the majority soap matrix are prepared separately from (in a separate stream) and preferably prior to preparation of the short chain soaps which will form the regions; at the temperatures soaps formed in the two streams are combined and are preferably mixed (30° to 50° C., preferably 35° to 45° C.), the soaps will not homogenize and short chain soap regions form within the long chain soap matrix.

Benefit agents may be added at saponification of either stream (typically high melting point benefit agents). Preferably, however, low melting point benefit agents are added during preparation of short chain soaps (at lower post-saponification temperature; or when the two streams are later combined).

Specifically, the process of the invention comprises:

a) saponifying fat material in which 75% or greater of said material (e.g., 75% of esterified chains found in the triglyceride material used) has chain length of $C_{14}$ or greater (to form long chain soap);

b) saponifying fat material in which 75% or greater of said material (as defined for (a)) has chain length $C_{12}$ or less (to form short chain soap) in a second, separate stream;

c) combining soaps formed from stream of a) with soaps formed from stream of b) at temperatures of 30° to 50° C.; and d) extruding combined soap mixture to form a bar.

Optionally, benefit agent(s) may be added during saponification step of either stream of (a) or (b). Optionally, low melting point benefit agent(s) may be added to stream of (b) at a stage where process temperature is lower (e.g., 30°-60° C.); or at step (c) when the streams are combined (e.g., at temperature of 30° or 50° C.).

Because the short chain soap region is made separately, fat materials having high level of chain length of $C_{12}$ and below, as a percent of all chain lengths in the starting fat, can be used as much lower level of overall fats while still obtaining a kappa phase. That is, one would not observe a kappa phase in a bar made using one-step saponification if there is less than 20% total amount $C_{12}$ or below soaps produced (as would occur using fat material where less than 20% chain length available for saponification in overall fat charge is $C_{12}$ or less). By contrast, using separate streams, applicants obtain a kappa phase (observed in the concentrated regions) even though amount of $C_{12}$ chain length and below available for saponification in overall fat charge (and consequent percent by wt. of overall $C_{12}$ and below soap) is as low as 3%. Typically, bars of the invention have total level of $C_{12}$ and below soap formed of 3 to 20% by wt., and level of long chain soap of 80 to 97% by wt. It should be understood that these figures are not limiting. That is, certainly fat material (overall fat charge) having more than 20% short chain available and less than 80% long chain available can be used.

Typically, short chain fat materials of the invention are saponified with sodium, although sodium and/or potassium can be used. It is also possible to form a concentrated region using separately formed, non-soap detergent noodles. The presence of concentrated regions can be readily confirmed using x-ray data.

The final matrix, in addition to soap (soap typically comprises about 50 to 85%, typically 60 to 85% by wt. of the matrix), comprises emollients, fillers, adjuvants (as noted above), and water. Emollients may include silicones, polyols, fatty acids, and oils, present at about 1 to 15% by wt. of the main matrix composition. Adjuvants are as noted above and water is present typically at 5 to 25%, preferably 8 to 15% by wt.

The concentrated regions typically comprise 50% to 85% soap by wt. (although typically 75% by wt. or more of this soap formed is short chain soap, 25% or less, preferably 15% or less, more preferably 10% or less may be longer chain), and the regions also comprise emollient, filler, adjuvant and water as noted in connection with the matrix. In one embodiment, the concentrated region comprises 70 to 85% by wt. soap (>85% of which is $C_{12}$ or lower), 1 to 10% emollient, for example, polyol (such as glycerine), 5 to 15% water and 0.1 to 5% adjuvant.

The overall amount of $C_{12}$ and lower chain length soap produced, based on fat having $C_{12}$ and lower chain length available, when counting both streams, is typically 3 to 20% by wt. total, preferably 7 to 15%.

Depending on the particular adjuvant distributed in the concentrated region, the region allows delivery of, for example, a perfume effect, or an antibacterial effect, far stronger than would be possible if the adjuvant had been incorporated in single step process and homogeneously distributed throughout the bar.

The soap found in the concentrated regions is prepared separately (in a second separate stream) from and preferably after (although order of streams is not critical) preparation of the soaps which will form the soap matrix.

The concentrated region (comprising majority lower chain soaps) may also be characterised by an x-ray pattern, as indicated, e.g., by the presence of a kappa phase pattern, which is characteristic of lower chain soaps concentrated in this region. More particularly, kappa phase will not typically be observed in the absence of sufficient short chain soaps. Thus, in a main matrix which comprises 75% or greater, preferably 80% or greater, more preferably 82% by wt. or greater soap of chain length $C_{14}$ or greater, such phase is not detected. By contrast, x-rays of bars of our invention readily show the kappa phase, even though overall amount of soap having chain length $C_{12}$ and below (as percent of overall soap produced from both streams) in final bar is relatively small.

DETAILED DESCRIPTION OF THE INVENTION

Figure 1:
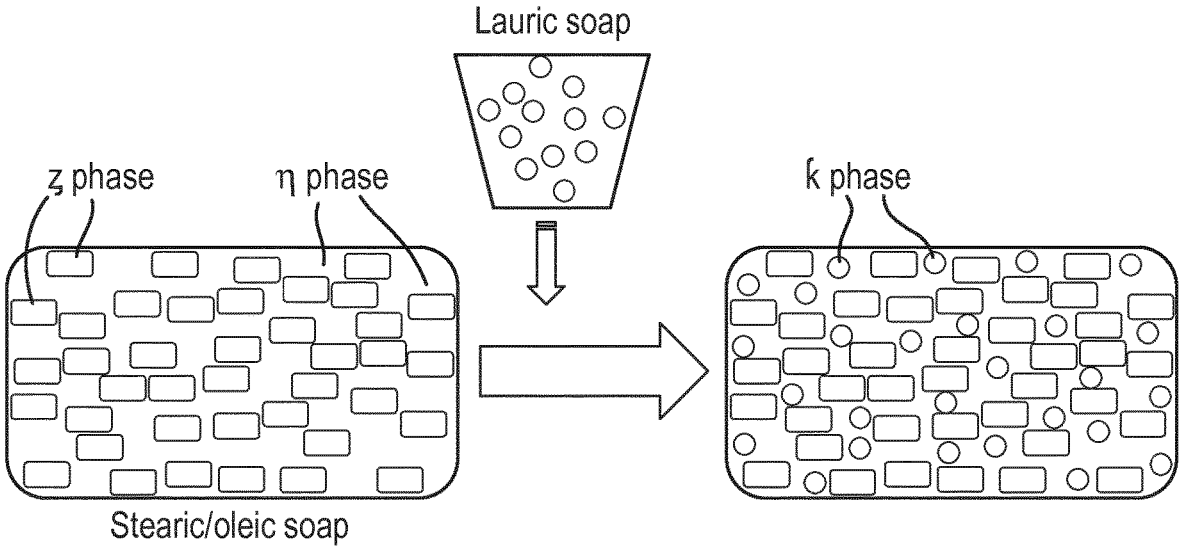
FIG. 1 is an illustration of the process of mixing the main soap matrix comprising higher chain length soap with short chain soap, which forms separate regions identified as kappa phase domains, even when there is an overall low level of short chain sodium soap as percent total soap used in the bar (as in this example).

Except in the examples, or where otherwise explicitly indicated, all numbers in this description indicating amounts of material or conditions of reaction, physical properties of materials and/or use are to be understood as modified by the word "about." All amounts are by weight of the final composition, unless otherwise specified.

It should be noted that in specifying any range of concentration or amount, any particular upper concentration can be associated with any particular lower concentration or amount.

For the avoidance of doubt, the word "comprising" is intended to mean "including" but not necessarily "consisting of" or "composed of." In other words, the listed steps or options need not be exhaustive.

The disclosure of the invention as found herein is to be considered to cover all embodiments as found in the claims as being multiply dependent upon each other irrespective of the fact that claims may be found without multiple dependency or redundancy.

The present invention is directed to soap bar composition comprising about 75 to 97% of the total volume of a matrix comprising predominantly long chain soap. The matrix soaps are made separately and preferably prior to the addition of soaps which are used to make up regions which will be dispersed in the matrix of the final bar. The matrix soaps are made in a stream (which can be called "first stream" separate from "second stream" in which predominantly short chain soaps are made) and the two are added later at relatively cooler temperature.

Some benefit agents (e.g., those which are intended to be mixed in the main matrix and for which it is not critical if delivered in separate domains) can be, and typically are, added in the first stream. They are added during saponification typically although they can be added post saponification (at low temperature) as well. For those benefit agents which have typically lower melting point and which we prefer not to homogenize throughout the matrix, these are preferentially added to the saponification stream where short chain soaps are made, but after saponification (e.g., at lower temperatures, preferably 30° C. to 60° C.); or at the time the second stream is mixed with the first. When the two streams are mixed, the benefit agents will tend to remain with second stream soaps. In fact, this allows certain components (perfumes, antibacterial agents) to be concentrated in the concentrated regions where they can be delivered more impactfully than if they had been delivered from the main soap matrix.

More specifically, fats selected to make the main matrix soaps are designed specifically to have relatively low concentration of $C_{12}$ and below fatty acid soaps formed. For example, 75% or greater, preferably 80% or greater, more preferably 82% or greater, even more preferably 85% or more of chain lengths available for saponification in fats chosen are $C_{14}$ and above and 25% or less, preferably 20% or less, more preferably 18% or less, more preferably 15% of chain lengths available are $C_{12}$ and below. Most preferably, if possible, 100% of chain lengths are $C_{14}$ and higher and 100% of final soaps in the matrix are long chain soaps. It is preferred to form as few short chain soaps in the matrix as possible.

Because the short chain soap region is made separately, fat materials having high level of chain lengths of $C_{12}$ and below, as a percentage of all chain lengths of the starting fat, is low (as percent of overall fat charge) but still forms concentrated low chain soap region where kappa phase is observed. Typically, the level of soap formed having chain length of $C_{12}$ and below is 3% to 20%, preferably 7 to 15%. Such low amounts would not typically form a kappa phase region in traditional bars where all soaps are formed together in a one-step process. Surprisingly, however, we are able to form regions where kappa phase is observed even though low levels of short chain soaps are formed overall.

Counterions used during formation of the long-chain soaps of the first stream are typically sodium, but may be sodium or potassium; soaps which will form the "regions" or domains of the invention are designed specifically to have predominantly chain length of $C_{10}$ and $C_{12}$. Typically, of the 50 to 85% soap comprising the concentrated regions, 75% or more are $C_{12}$ and lower chain length, although 25% or less, preferably 15% or less may be long chain length. Again, counterion used to form the soap may be sodium and/or potassium.

Soaps predominantly made from $C_{10}$ and $C_{12}$ typically have a melting point range such that, when combined with soaps of the main matrix and/or other ingredients at temperatures of about 30° C. to less than 50° C., preferably 30-45° C., the melting temperature of the soaps forming the main matrix is high enough that the soaps forming the concentrated domains will stay in independent regions, i.e., not disperse homogenously with the soaps forming the main matrix.

Benefit agents can be added to the long-chain length stream (typically higher melting point benefit agents). Some benefit agents (typically lower melting point) are preferably added at the time lower chain length soaps are made (post saponification at lower temperatures, but before the two soaps are combined); or at the time the predominantly short chain soaps are mixed with long chain soaps. The benefit agents added to the lower chain length stream will typically be chosen to have melting points (e.g., 30-45° C.) so that they will not fully melt when added to a mixer at 30-45° C. (for example, at the time the two soap streams are combined) and will thus remain in concentrated areas; simultaneously the melting point of such agents is low enough so that they will not be gritty when collected in the concentrated region. That is, they are "soft" enough to not cause gritty feel, yet are sufficiently soluble to provide performance in use when delivered from concentrated regions.

In short, the bars of the invention provide certain concentrated regions or domains containing predominantly short chain length fatty acid soaps and further optionally containing certain selected benefit agents (typically added in when soaps are combined) having defined melting points. Typically, as indicated, these adjuvants would remain in the region of the short chain soaps. Without wishing to be bound by theory, it is believed the benefit agents are "entrapped" in the regions. By adding these separately formed lower and higher chain length soaps, and optional benefit agents, at a point when they are mixed at lower temperatures, these concentrated regions are not mixed homogeneously into the bar matrix soaps. Benefits of the concentrated lower chain length soaps (e.g., enhanced foaming), as well as benefits of the optionally added benefit agents entrapped within (perfume, antibacterial), which benefits (enhanced perfume burst, enhanced antibacterial activity) are associated with those concentrated regions, can thus be efficiently delivered.

Figure 2:
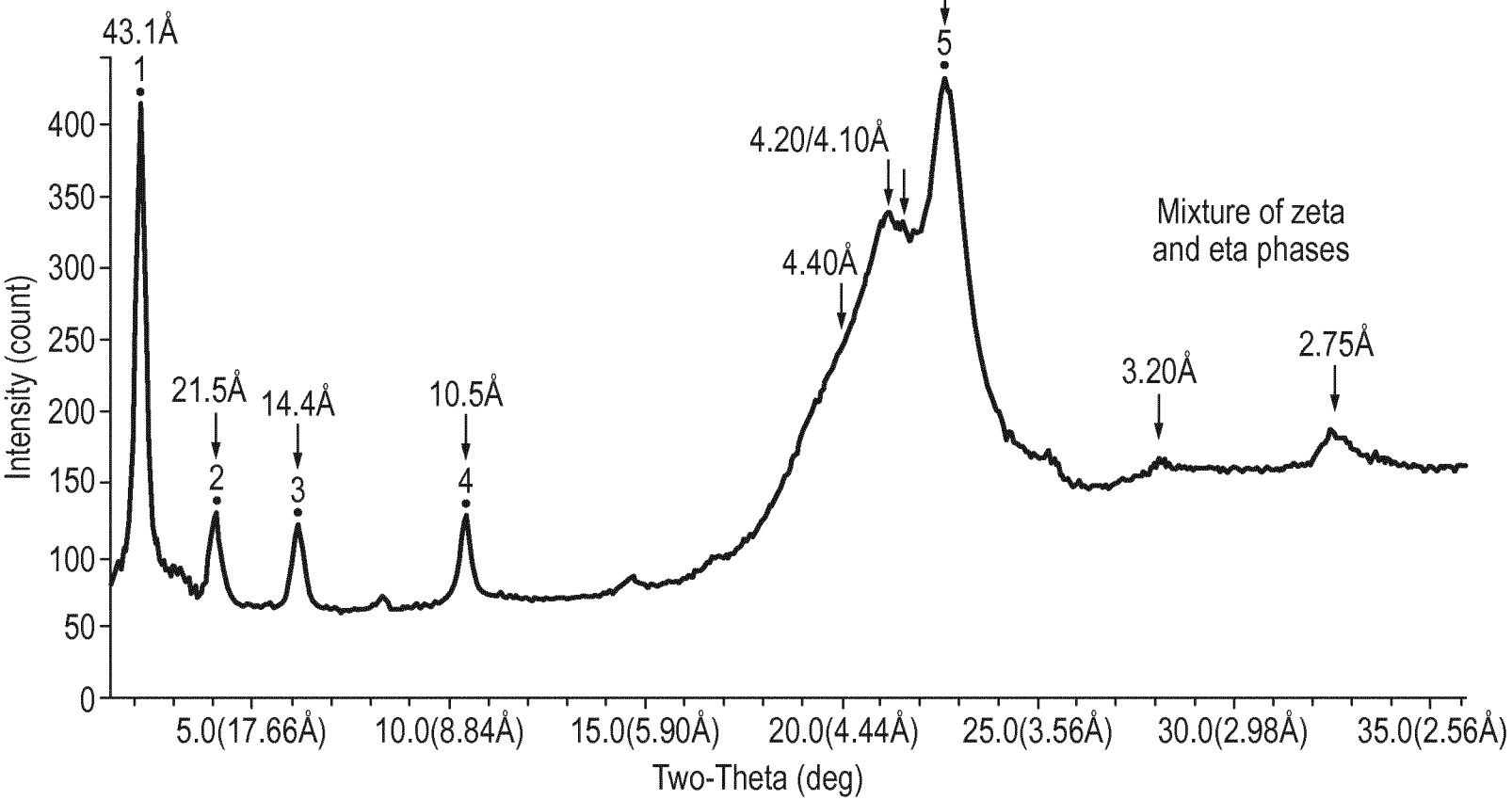
FIG. 2 is a combined small and wide angle X-ray spectrum of a bar formed when soaps of both long and short chain are mixed together, as occurs for formation of matrix noodles (or for bars made in one stream process typically). In the long d-spacing region we see a principal peak at 43.1 Å, followed by a sequence of diffraction peaks at $d_o/2$, $d_o/3$, $d_o/4$. This d-spacing (around 40 Å) is typical for both zeta phase formed by long saturated chain soap (C18, C16), and eta phase, formed by long chain unsaturated chain soap (C18:1) and the mixture of long unsaturated and short saturated soap. In the short d-spacing region we observe peaks characteristic of both zeta phase: 2.75 Å (medium), 3.20 Å (weak) and 3.92 Å (very strong)), and eta phase: 4.10 Å (very strong, 4.25 Å (very strong) 4.40 Å (strong). As seen, when the overall amount of $C_{12}$ and below is relatively low (3% to 20% in bars of our invention), there is a mix of zeta and eta phases, but no kappa phase.
Figure 3:
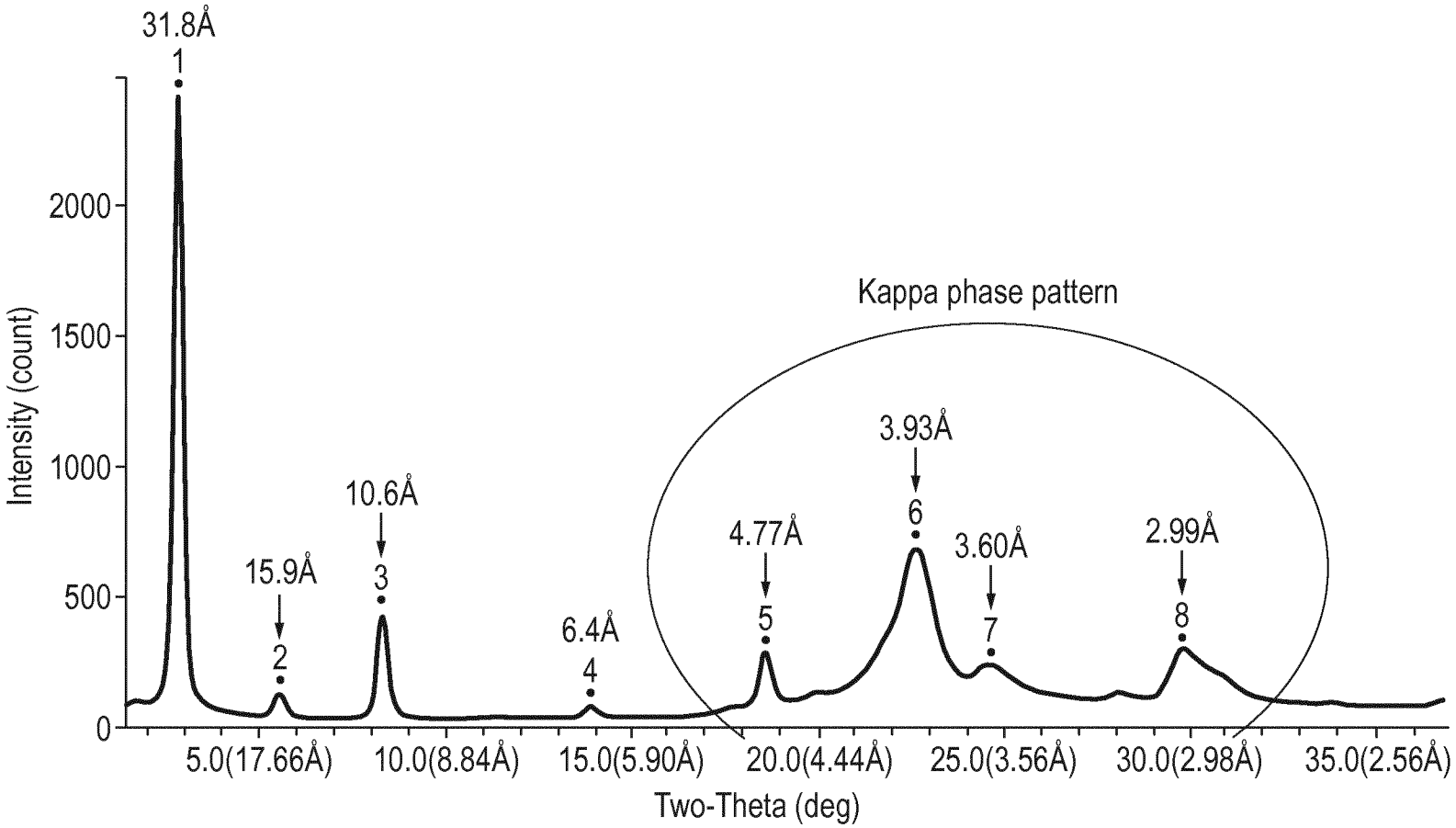
FIG. 3 is a combined small and wide angle X-ray spectrum of the second stream short chain soap. In the long d-spacing region the main peak is observed at d-spacing 31.8 Å. In the short d-spacing region, the x-ray pattern consists of four peaks: 2.99 Å (medium strong), 3.60 Å medium weak), 3.93 Å (strong), and 4.77 Å (medium). This pattern is characteristic of kappa phase and is very different from the pattern observed for the main stream soap.
Figure 4:
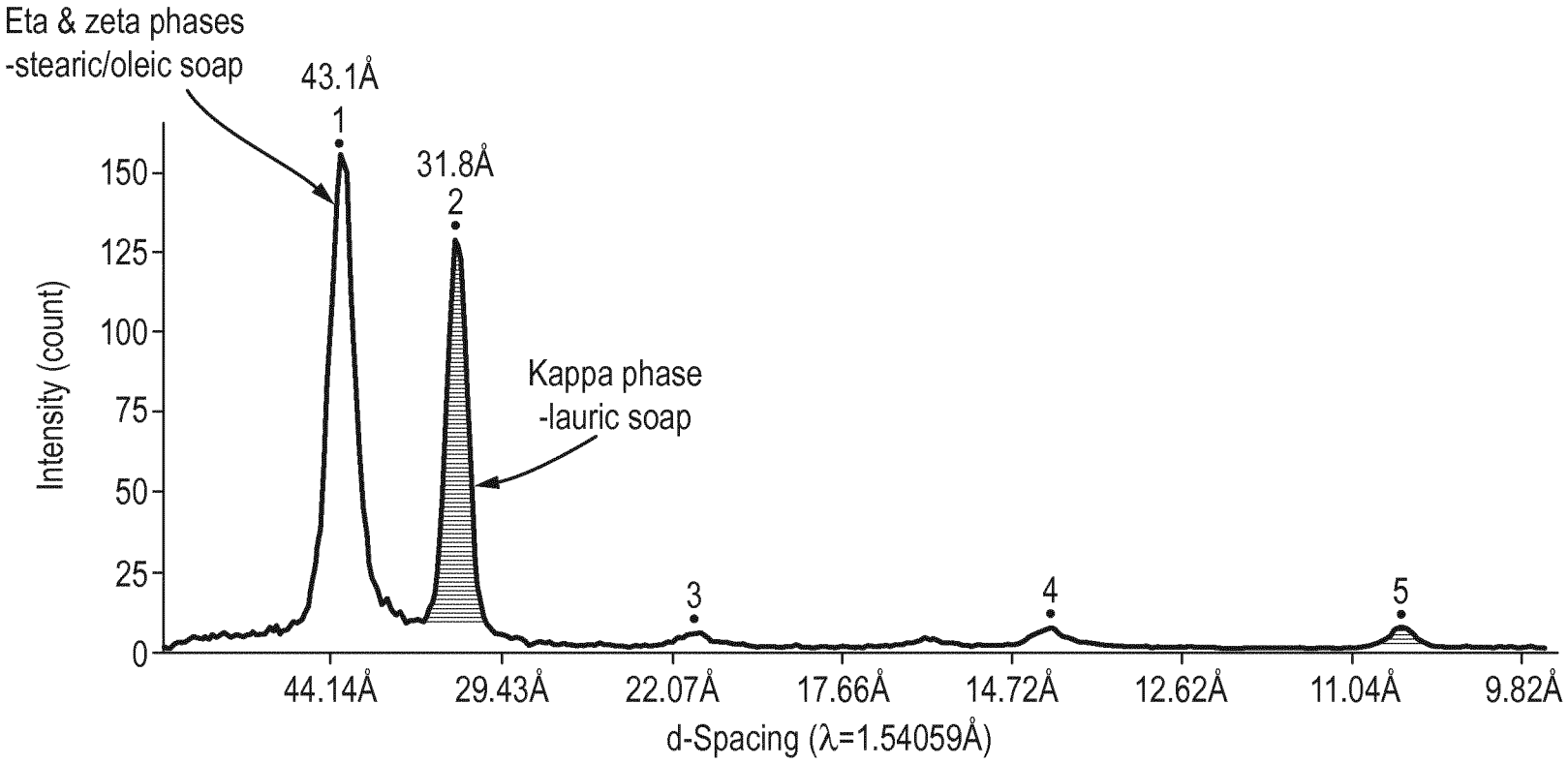
FIG. 4 is a small angle X-ray spectrum of a bar containing 15% sodium laurate soap added as a second stream. In the short d-spacing region the spectrum shows two principal peaks at 43.1 Å and 31.8 Å corresponding to combined zeta and eta phases (main stream soap), and kappa phase (second stream soap) respectively. As can be seen, even though $C_{12}$ is small percentage of overall fat stock (3 to 20%), it is concentrated and thus forms an observable kappa phase.

The overall percent $C_{12}$ and below chain length available for saponification from fats used in both streams is typically about 3 to 20%, preferably 7 to 15%. Thus, this is the amount of $C_{12}$ soap which will form upon saponification. Typically, at $C_{12}$ soap amount of 20% or less in total bar, no kappa phase would be seen in x-ray. However, since we make separate streams, the soap of chain length $C_{12}$ or less is concentrated and kappa phase pattern is seen. FIG. 1 is an illustration of this overall FIG. 2 is an x-ray of bar matrix and shows how typically, in main matrix (as in bars made by one step process, especially where overall amount of soap charge is 20% or less), kappa phase is not seen. FIG. 3 shows concentrated regions that form kappa phase. FIG. 4 shows an x-ray of bar comprising 15% of sodium laurate added as a separate stream; here we see the presence of kappa phase and the mixture of eta and zeta phases.

The invention also comprises bars obtainable from, preferably obtained from process defined.

Brief Description of the Process

The process is briefly described below:

First step—main stream production: Saponification (typically with sodium counterions) of primarily non-lauric oils with caustic soda (by "non-lauric" is meant long saturated (primarily $C_{16}$ and $C_{18}$) and unsaturated ($C_{18:1}$, $C_{18:2}$, traces of $C_{18:3}$) fatty acids found in palm oil, palm oil stearine, tallow, etc.). As indicated earlier, fats having broad chain length of $C_{14}$ to $C_{24}$ may be used, but those of chain length $C_{16}$ to $C_{18}$ are preferred. Higher melting point benefit agents (and/or those for which it is not critical or important if they are homogeneously distributed throughout the bar matrix) can be separately added to this main stream. Benefit agents may also be added after saponification.

Second step—Saponification of fatty acids or lauric oils (i.e., $C_8$ to $C_{12}$, palm kernel oil, coconut oil, etc.) with selected alkali ($Na^+$ and/or $K^+$); soap fats comprising $C_8$ to $C_{12}$ are preferred Typically, no high melting point benefit agents are used at saponification here. Lower melting point benefit agents may be added either post saponification at later stage when temperature is lower, but before mixing with soaps formed in the high soap stream, or at mixing step; at mixing the benefit agents will tend to remain in the concentrated areas.

Third step—Mixing between the main stream (comprising saponified longer chain soaps and optional higher melting point adjuvants) and second stream (comprising saponified lower chain soaps and optional lower melting point adjuvants, preferably only lower melting point adjuvants). Typically, the two streams are mixed for 1 to 15 minutes, preferably 2 to 10 minutes. The streams may be mixed for much longer than this (although this would prolong the process) without, applicants have found, affecting lather enhancement delivered from the concentrated regions. The mixing occurs in a finishing line step (for example, a Z-blade mixer) where the temperature profile is maximum 50° C., preferably 30-45° C. Lower melting point benefit agents can separately be added during mixing (or as noted, at lower temperatures found at the later stage when second stream soaps are formed but before both streams are mixed). Typically, these are agents which are preferably not homogenized throughout the product and which will be more efficiently delivered from the domain regions.

It should be understood that "first" and "second" steps are interchangeable and not necessarily in a time sequence.

The compositions and the process for making this are described in more detail below.

Main Matrix

The main soap bar matrix (in which regions or domains are interspersed) is made predominantly from longer molecular weight ($C_{14}$ to $C_{22}$) fatty acid soaps as discussed above which are typically insoluble and do not readily generate foam.

Specifically, this region is the brick and mortar of the bar and is designed to have as relatively little $C_{12}$ and below chain length soaps as possible.

More specifically, this main region may comprise a level of 75 to 97% of total bar volume. The main matrix region comprises typically 50 to 85%, preferably 60 to 85% by wt. soap and typically 75% or greater, preferably 85% or greater more preferably 95% by wt. of these soaps should be $C_{14}$ or greater, preferably $C_{14}$ to $C_{24}$, more preferably $C_{16}$ to $C_{24}$. This includes partially unsaturated chain lengths such as unsaturated $C_8$. At these low levels of short chain length, kappa phase is not typically seen (FIG. 2).

Further, the counterion used during saponification of the starting soap bar material (starting fat or oil) may be, for example, sodium or potassium.

Typically, main stream benefit agents (especially high melting point benefit agents) are added at saponification. They may also be added after saponification, but should be added before the main stream soaps are mixed with second stream. When mixed with second stream soaps, lower melting point benefits may typically be added, and these will tend to stay in the concentrated regions.

As noted, the matrix soaps are prepared separately from soaps making up regions or domains of the invention (added to what we are calling "second stream"). It is an important part of the invention that when soaps forming domains of the invention are made and mixed with the matrix soaps later, the mixing temperature is lower than the mixing temperature at which either of the two soaps are formed. As such, the matrix soaps do not melt and mix homogeneously with the domain soaps. Typically, two soaps are mixed from 1 to 15 minutes, preferably 2 to 10 minutes.

Typically, main stream soaps are made by saponifying non-lauric oils and unsaturated fatty acids found, for example, in palm oil, palm oil stearine, etc.

The main matrix, as noted, comprises 50 to 85% by wt. soaps. In addition, there may be found emollients, fillers, adjuvants and water all added as noted above.

Typically, applicants may include silicones and other emollients. Silicones include linear, cyclic and substituted silicones. Other emollients include polyols, fatty acids and vegetable, mineral and animal oils.

Glycerin and sorbitol are preferred polyols. Preferred fatty acids include babassu fatty acid and lauric acid. Typical vegetable oils include sunflower oil, corn oil and almond oil.

Emollients may comprise 1-15% by wt. of the matrix.

Fillers such as talc, starch, calcium carbonate, may comprise 1-25% by wt. of the main matrix.

Adjuvants may include perfumes and dyes and comprise typically up to 0.1-5% by wt. of the main matrix.

Domains or Regions

A critical aspect of the subject invention is the preparation of soaps which will form concentrated regions or domains which are prepared separately from the soaps which will form main matrix. These regions comprise predominantly lower molecular fatty acid soaps ($C_{12}$, preferably $C_8$ to $C_{12}$ chain length and below).

More specifically, the regions may comprise about 3 to 25%, preferably 5 to 20%, more preferably 5 to 15% of the total bar volume. The concentrated regions typically comprise 50 to 85% soap, and typically 85% or greater, more preferably 90% or greater by wt. are $C_8$ to $C_{12}$ (preferably $C_{10}$ to $C_{12}$) soaps.

Although regions comprise high levels of $C_{12}$ and below, they represent typically only about 3 to 20% by wt. of all soaps in the bar. However, since the $C_{12}$ and below is concentrated, a kappa phase is seen (FIG. 4).

Further, the counterion used to saponify the fats may be sodium and/or potassium. Use of certain counterions can help alter characteristics.

Typically, this step includes saponification of fatty acids or lauric oils (e.g., $C_8$ to $C_{12}$, palm kernel oil, coconut oil) and alkali such as sodium and/or potassium.

These soaps are formed in a separate "second" stream. As noted, the regions comprise 50 to 85% soap. In addition, there may be found emollients, fillers, adjuvants and water. Emollients, fillers and adjuvants are as defined for matrix above. In one preferred embodiment, the region comprises 70 to 90% soap; 1 to 15% emollient (especially glycerin), 5 to 15% water and 0.1 to 5% adjuvant. Typically high melting point benefit agents are not added during saponification of fats forming short chain soaps although, theoretically, they may be. Typically, the lower melting point benefit agents are added to second stream at later stage (where there are lower temperatures). These are typically added before the soaps made in the main stream are combined; when the two streams are later combined, the lower melting point agents will tend to stay in second stream soaps. As mentioned, it is also possible to add lower melting point benefit agents at the actual mixing of the two streams.

Once formed, the short chain soaps forming the domains (and optionally low melting point adjuvants) are mixed with long chain soaps which form the main matrix. Specifically, in the finishing line (mixer) the domain soaps are mixed with the main stream soap. The soaps incorporate well but they do not mix at the microstructure level due to the low temperature conditions. It is believed that it is this lack of extreme homogenization which causes the formation of the micro domains. More particularly, the streams are mixed at a temperature of about 50° C. and below, preferably at 30° C. to 45° C. so that the lower-chain length soaps will homogenize but stay as separate domains interspersed throughout the matrix. These domains can thus more effectively deliver benefits associated with lower chain length soaps (e.g., foaming), as well as benefits of any adjuvant/benefit adjuvant which were optionally added as noted above. The mixing time is typically 1 to 15 minutes, preferably 2 to 10 minutes.

It should be noted that, rather than second stream short chain soaps, it is also possible to make second stream solid non-soap detergent bits. These can then be mixed with main stream soap at lower finishing line temperatures to form separate regions of non-soap detergent.

Process

As described previously, the process to produce the soap (main stream and domains) is split in two steps:

First step—main stream is produced using only long carbon chain ($\geq C_{14}$), preferably with caustic soda. Unsaturated fatty acids (e.g., oleic) may be used.

Second step—the domain is produced using short carbon chain ($C_{12}$ and below) with caustic soda and/or caustic potash.

The first and second steps are run independently and not necessarily in that order.

It is only in the finishing line that the short chain soaps that will form the domain are mixed with the main stream. The "domain soap" is preferably the last "ingredient/base" added in the mixer, preferably a Z-blade mixer.

A typical finishing batch would be:

about 92% main stream soap 1-2% dye+perfume (mix for 9-12 minutes);

Add about 7% domains (mix for 1-10 minutes).

After the mixing stage, the soap mass is unloaded from the mixer and the mass is passed through the roll mills and plodder.

After the plodder, soap billets are cut and stamped.

The resulting bars will typically have a hardness value (measured at mm/s (Kg) at 40° C.) of at least 3 and preferably in the range of 3.0 to 5 Kg.

Protocol

Hardness Testing Protocol

Principle

A 30° conical probe penetrates into a soap/syndet sample at a specified speed to a pre-determined depth. The resistance generated at the specific depth is recorded. This number can be related to the yield stress.

Hardness (or yield stress) can be measured by a variety of different penetrometer methods.

Apparatus and Equipment

TA-XT Express (Stable Micro Systems)

300 conical probe—Part #P/30c (Stable Micro Systems)

Sampling Technique

This test can be applied to billets from a plodder, finished bars, or small pieces of soap/syndet (noodles, pellets, or bits). In the case of billets, pieces of a suitable size (9 cm) for the TA-XT can be cut out from a larger sample. In the case of pellets or bits which are too small to be mounted in the TA-XT, the compression fixture is used to form several noodles into a single pastille large enough to be tested.

Procedure

Setting Up the TA-XT Express

These settings need to be inserted in the system only once. They are saved and loaded whenever the instrument is turned on again.

Set test method

Press MENU

Select TEST SETTINGS (Press 1)

Select TEST TPE (Press 1)

Choose option 1 (CYCLE TEST) and press OK

Press MENU

Select TEST SETTINGS (Press 1)

Select PARAMETERS (Press 2)

Select PRE TEST SPEED (Press 1)

Type 2 (mm $s^{-1}$) and press OK

Select TRIGGER FORCE (Press 2)

Type 5 (g) and Press OK

Select TEST SPEED (Press 3)

Type 1 (mm $s^{-1}$) and press OK

Select RETURN SPEED (Press 4)
Type 10 (mm $s^{-1}$) and press OK
Select DISTANCE (Press 5)
Type 15 (mm) for soap billets or 3 (mm) for soap pastilles and press OK
Select TIME (Press 6)
Type 1 (CYCLE)
Calibration
Screw the probe onto the probe carrier.
Press MENU
Select OPTIONS (Press 3)
Select CALIBRATE FORCE (Press 1)—the instrument asks for the user to check whether the calibration platform is clear
Press OK to continue and wait until the instrument is ready.
Place the 2 kg calibration weight onto the calibration platform and press OK
Wait until the message "calibration completed" is displayed and remove the weight from the platform.
Sample Measurements
Place the billet onto the test platform.
Place the probe close to the surface of the billet (without touching it) by pressing the UP or DOWN arrows.
Press RUN
Take the readings (g or kg) at the target distance (Fin).
After the run is performed, the probe returns to its original position.
Remove the sample from the platform and record its temperature.
Calculation & Expression of Results
Output The output from this test is the readout of the TA-XT as "force" ($R_T$) in g or kg at the target penetration distance, combined with the sample temperature measurement.

The force reading can be converted to extensional stress, according to Eqn. 2.

The equation to convert the TX-XT readout to extensional stress is $$\sigma = \frac{1}{C}\frac{R_T g_c}{A}$$

where: σ=extensional stress
C="constraint factor" (1.5 for 30° cone)
$G_c$=acceleration of gravity
A=projected area of cone=$\pi(d \tan \frac{1}{2}\theta)^2$
d=penetration depth
θ=cone angle
For a 30° cone at 15 mm penetration Eqn. 2 becomes $$\sigma\ (\text{Pa}) = R_T\ (\text{g}) \times 128.8$$

This stress is equivalent to the static yield stress as measured by penetrometer.

The extension rate is $$\dot{\varepsilon} = \frac{V}{d\tan\left(\frac{1}{2}\theta\right)}$$

where $\dot{\varepsilon}$=extension rate ($s^{-1}$)
V=cone velocity
For a 30° cone moving at 1 mm/s, $\dot{\varepsilon}$=0.249 $s^{-1}$
Temperature Correction The hardness (yield stress) of skin cleansing bar formulations is temperature-sensitive. For meaningful comparisons, the reading at the target distance (RT) should be corrected to a standard reference temperature (normally 40° C.), according to the following equation:

$$R_{40} = R_T \times \exp[\alpha(T-40)]$$

where $R_{40}$=reading at the reference temperature (40° C.)
$R_T$=reading at the temperature T
α=coefficient for temperature correction
T=temperature at which the sample was analyzed.

The correction can be applied to the extensional stress.

Raw and Processed Data

The final result is the temperature-corrected force or stress, but it is advisable to record the instrument reading and the sample temperature also.

Lather Volume Protocol
Definitions:

Lather volume is related to the amount of air that a given soap bar composition is capable of trapping when submitted to standard conditions.

Principle:

Lather is generated by trained technicians using a standardised method. The lather is collected and its volume measured.

Apparatus and Equipment:
Washing up bowl—1 per operator capacity 10 litres
Soap drainer dishes—1 per sample
Surgeons' rubber gloves—British Standard BS 4005 or equivalent (see Note 14ii).
Range of sizes to fit all technicians
Tall cylindrical glass beaker—400 mL, 25 mL graduated (Pyrex n°1000)
Thermometer—Mercury types are not approved
Glass rod—Sufficiently long to allow stirring in the glass beaker
Procedure:
Tablet Pre-Treatment:

Wearing the specified type of glove well washed in plain soap, wash down all test tablets at least 10 minutes before starting the test sequence. This is best done by twisting them about 20 times through 180° under running water.

Place about 5 litres of water of known hardness and at a specified temperature (see Note) in a bowl. Change the water after each bar of soap has been tested.

Take up the tablet, dip it in the water and remove it. Twist the tablet 15 times, between the hands, through 180°. Place the tablet on the soap dish (see Note).

The lather is generated by the soap remaining on the gloves.

Stage 1: Rub one hand over the other hand (two hands on same direction) 10 times in the same way (see Note).
Stage 2: Grip the right hand with the left, or vice versa, and force the lather to the tips of the fingers.
This operation is repeated five times.
Repeat Stages 1 and 2
Place the lather in the beaker.

Repeat the whole procedure of lather generation from paragraph iii, twice more, combining all the lather in the beaker.

Stir the combined lather gently to release large pockets of air. Read and record the volume.

Calculation & Expression of Results:

The data obtained consists of six results for each bar under test.

Data analysis is carried out by two way analysis of variance, followed by Turkey's Test.

Operators:

Experienced technicians should be able to repeat lather volumes to better than ±10%. It is recommended that technicians be trained until they are capable of achieving reproducible results from a range of different formulation types.

Notes:

Water temperature should reflect local conditions, or alternatively tests may be done at more than one temperature. Once decided upon, the water temperature should be adhered to and should be reported with the results.

Similarly, water hardness should be constant for a series of tests and should be recorded. Where possible, it is preferable to adhere to suitable water hardness.

It is important to keep the number of rubs/twists constant.

Examples

In order to compare lather and rheology results (hardness), applicants prepared the following bars:

| Comparative A | Comparative B | Example 1 | Example 2 | Example 3 |
|---|---|---|---|---|
| 100% main stream soap base: stearic-oleic soap from palm oil-palm stearin oil; | Bar where all soap fats/oils mixed together are palm oil-palm stearin/palm kernel oil; | 7% $C_{10}$ sodium soap; 93% main stream soap base (same as A) | 7% $C_{12}$ sodium soap; 93% main stream soap base (same as A) | 7% $C_{10}$-$C_{12}$ sodium soap; 93% main stream soap base (as A) |
| No short chains | Short chain mixed with long chains | Short chains in concentrated regions. | Short chains in concentrated regions | Short chains in concentrated regions |

| Example 4 | Example 5 | Example 6 | Example 7 |
|---|---|---|---|
| 7% $C_{10}$ potassium soap; 93% main stream soap base (same as A) | 7% $C_{12}$ potassium soap; 93% main stream soap base (same as A) | 7% $C_{10}$-$C_{12}$ potassium soap; 93% main stream soap base (same as A) | 7% capric-lauric-oleic potassium soap; 93% main stream soap base (as A) |
| Short chains in concentrated regions | Short chains in concentrated regions | Short chains in concentrated regions | In concentrated regions |

Bars 1-7 were prepared as per the invention wherein the main stream soap base was prepared separately from shorter-chain soap stream and the two streams were combined and mixed with temperatures ranging from 30 to 45° C. In comparatives A & B, all chain-length fats/oils were saponified at once.

Applicants next compared lather volume and rheology results for the various bars:

| Bar | Lather Volume (mL) | Hardness (Kg) at 40° C. in 15 mm penetration |
|---|---|---|
| A | 190 | 5.38 |
| B | 220 | 4.00 |
| 1 | 271 | 3.43 |
| 2 | 266 | 4.55 |
| 3 | 287 | 4.37 |
| 4 | 359 | 3.40 |
| 5 | 334 | 3.12 |
| 6 | 324 | 3.27 |
| 7 | 355 | 4.63 |

As seen from the data above, the bars of this invention, having separate regions or domains interspersed in soap matrix, have hardness values comparable to comparative bars where soap fats/oils are saponified altogether. This ensures that bars can be extruded and shaped in high throughout manufacture. Typically, hardness values are in a range of 3.00 to 5.00 Kg measured at 40° C. in 15 mm penetration. This is an acceptable range for industrial production of bars.

Further, the bars maintain sufficient manufacturing hardness while providing greatly enhanced lather volume relative to comparative bars. Specifically, comparative bars had lather volume of 190 and 220 milliliter, while bars of invention had lather ranging from 266 to 355 milliliter.

While not wishing to be bound by theory, it is believed that delivery of lower chain-length soaps in domains or regions allows the bars to maximize foaming effect of the low-chain length soaps and thereby increases foaming values of the entire bar.

The invention claimed is:

1. A method for making a soap bar composition comprising the steps of:

a) neutralizing fat in which 75% or greater of chain lengths are $C_{14}$ or greater in a first stream to produce long chain soap;

b) neutralizing fat in which 75% or greater of chain lengths are $C_{12}$ or less in a second and distinct stream to produce short chain soap; and c) combining and mixing the soaps to make a soap bar composition wherein the soap bar composition comprises 75 to 97%, based on total volume of the bar, of a matrix comprising the long chain soap; and 3 to 25%, based on total volume of the bar, regions interspersed in said matrix, the regions comprising the short chain soap, and the long chain soap and short chain soap are neutralized with sodium and/or potassium and the soap bar composition has an observable kappa phase with the short chain soap interspersed in the matrix of the long chain soap.

2. The method according to claim 1 wherein the bar matrix comprise 50-85% by weight soap.

3. The method according to claim 1 wherein the interspersed regions comprise 50-85% by weight soap.

4. The method according to claim 1 wherein the soaps are combined at a temperature that does not exceed 50° C.

5. The method according to claim 1 wherein the soaps are combined at a temperature that is from 30 to 45° C.

6. The method according to claim 1 wherein region and matrix further comprise emollient, fillers, adjuvants and water.

7. The method according to claim 1 wherein $C_{12}$ and below chain length soap in the soap bar composition is 3 to 20% by weight.

8. The method according to claim 1 wherein the matrix comprises 60 to 85% by weight soap that is $C_{14}$ to $C_{24}$.

9. The method according to claim 8, wherein the matrix comprises soap that is $C_{16}$ to $C_{24}$ and includes soap that is unsaturated $C_{18}$.

10. The method according to claim 1 wherein the region comprises 5 to 15% of the total bar volume and 90% or greater by weight of the soaps in the region are $C_8$ to $C_{12}$.

11. The method according to claim 1 wherein the mixing of long chain soap and short chain soap is at a temperature ranging from 30 to 50° C.

12. The method according to claim 1 wherein the mixing of long chain soap and short chain soap is at a temperature ranging from 35 to 45° C.

13. The method according to claim 1 wherein the soaps are combined and not homogenized.

* * * * *